US012760399B2

(12) United States Patent
Yan et al.

(10) Patent No.: US 12,760,399 B2
(45) Date of Patent: Oct. 13, 2026

(54) STEEL SHEET PLATED WITH ZINC-ALUMINUM-MAGNESIUM-CALCIUM ALLOY BY MEANS OF HOT DIPPING AND MANUFACTURING METHOD THEREFOR

(71) Applicant: BAOSHAN IRON & STEEL CO., LTD., Shanghai (CN)

(72) Inventors: Yuanyuan Yan, Shanghai (CN); Weihua Sun, Shanghai (CN); Yiming Chen, Shanghai (CN); Qingge Meng, Shanghai (CN); Jingge Dai, Shanghai (CN); Chuanhua Lin, Shanghai (CN); Xianlu Meng, Shanghai (CN); Jie Liu, Shanghai (CN); Xiangpeng Yang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 0 days.

(21) Appl. No.: 18/873,416

(22) PCT Filed: Jun. 12, 2023

(86) PCT No.: PCT/CN2023/099708
§ 371 (c)(1),
(2) Date: Dec. 10, 2024

(87) PCT Pub. No.: WO2023/241515
PCT Pub. Date: Dec. 21, 2023

(65) Prior Publication Data

US 2025/0369083 A1 Dec. 4, 2025

(30) Foreign Application Priority Data

Jun. 13, 2022 (CN) ..... 202210678290.X

(51) Int. Cl.
*C23C 2/06* (2006.01)
*C22C 18/04* (2006.01)
(Continued)

(52) U.S. Cl.
CPC ..... *C23C 2/06* (2013.01); *C22C 18/04* (2013.01); *C23C 2/261* (2022.08); *C23C 2/29* (2022.08); *C23C 2/40* (2013.01); *C23C 2/50* (2022.08)

(58) Field of Classification Search
CPC ..... C23C 2/06; C23C 2/40; C22C 18/04
See application file for complete search history.

(56) References Cited

U.S. PATENT DOCUMENTS

2004/0258949 A1 12/2004 Honda
2012/0282488 A1* 11/2012 Fujii ..... C23C 2/12 427/349
2022/0145425 A1 5/2022 Mitsunobu

FOREIGN PATENT DOCUMENTS

CN 1612947 A 5/2005
CN 101405421 A 4/2009
(Continued)

OTHER PUBLICATIONS

CN 1st OA dated Mar. 27, 2025 for CN 202210678290.X w/Machine ENTRAN.
(Continued)

*Primary Examiner* — Robert A Vetere
(74) *Attorney, Agent, or Firm* — Lei Fang, Esq.; Smith Tempel Blaha LLC

(57) ABSTRACT

Disclosed is a steel sheet plated with a steel sheet hot-dipped with a zinc-aluminum-magnesium-calcium alloy coating comprising a steel substrate and an alloy plating on a surface of the steel substrate. The chemical elements of the alloy coating include Zn, inevitable impurities, and the following
(Continued)

chemical elements in mass percentages: Al: 12-27%, Mg: 2-8%, Ca: 0.02-5%, and Si: 0.15-1.0%, wherein the mass percentage contents of Al, Mg and Ca in the alloy plating further satisfy the following relations: 4%≤(Mg+Ca)≤10%, and Al/(Mg+Ca)≥2.5. Further disclosed is a manufacturing method for manufacturing the steel sheet.

12 Claims, 3 Drawing Sheets

(51) Int. Cl.

| | |
|---|---|
| ***C23C 2/00*** | (2006.01) |
| ***C23C 2/26*** | (2006.01) |
| ***C23C 2/28*** | (2006.01) |
| ***C23C 2/40*** | (2006.01) |

(56) References Cited

FOREIGN PATENT DOCUMENTS

| | | | |
|---|---|---|---|
| CN | 102762759 | A | 10/2012 |
| CN | 103507324 | A | 1/2014 |
| CN | 111519117 | A | 8/2020 |
| CN | 113025937 | A | 6/2021 |
| EP | 4230757 | A | 8/2023 |
| JP | S56152954 | A | 11/1981 |
| JP | 2015-193879 | A | 11/2015 |
| WO | 2018/037916 | A1 | 9/2018 |
| WO | 2018/139620 | A1 | 1/2019 |
| WO | 2022/080004 | A1 | 4/2022 |

OTHER PUBLICATIONS

JP 1st OA dated Feb. 17, 2025 for JP 2024-573347 w/Machine ENTRAN.

The extended EU search report dated Aug. 25, 2025 for EP App No. 23823083.3.

International Search Report for PCT/CN2023/099708 dated Sep. 29, 2023.

International Written Opinion for PCT/CN2023/099708 dated Sep. 29, 2023.

* cited by examiner

STEEL SHEET PLATED WITH ZINC-ALUMINUM-MAGNESIUM-CALCIUM ALLOY BY MEANS OF HOT DIPPING AND MANUFACTURING METHOD THEREFOR

CROSS-REFERENCE TO RELATED APPLICATIONS

This application is a 371 U.S. National Phase of PCT International Application No. PCT/CN2023/099708 filed on Jun. 12, 2023, which claims benefit and priority to Chinese patent application No. CN202210678290.X filed on Jun. 13, 2022, the contents of each of the above listed applications are incorporated by reference herein in their entiries.

TECHNICAL FIELD

The present disclosure relates to a steel and a method for manufacturing the same, in particular to a coated steel sheet and a method for manufacturing the same.

BACKGROUND ART

It's well known that hot dipping is a cost-effective process for steel surface treatment. It can be used to prepare new coatings with higher corrosion resistance and better economy, and has always been a hot subject in the development of steel surface.

In the past 20 years, zinc-aluminum-magnesium coatings have always been a major hot subject in the research on highly corrosion-resistant coatings. This type of coatings is based on the original coatings such as GI (Zn-0.2% Al), GF (Zn-5% Al), GL (55% Al-43.5% Zn-1.5% Si), with further addition of various contents of the Al and Mg elements to improve the corrosion resistance of the coatings, thereby achieving an upgrade in the corrosion resistance of the original coatings.

Since entering the 21st century, a series of zinc-aluminum-magnesium coated products with different Al contents have gradually been formed around the world, which have been widely used in the fields of automobiles, home appliances, construction, etc. Along with the current development trend of green, low-carbon and environmentally friendly steel materials, it's desired to further explore and develop methods for promoting the corrosion resistance of coated steel sheets.

For example, Chinese Patent Application CN1342211A, published on Mar. 27, 2002, and titled "COATED STEEL, COATED STEEL SHEET AND PAINTED STEEL SHEET WITH EXCELLENT CORROSION RESISTANCE AND MANUFACTURING METHOD THEREOF", provides a coated steel with excellent corrosion resistance and a method for manufacturing the same. In this technical solution, the coating comprises Mg: 1-10 wt %, Al: 2-19 wt %, Si: 0.01-2 wt %, and Mg+Al meets Mg (%)+Al (%)≤20%. It may also comprise elements such as In, Bi, Sn, Ca, Be, Ti, and the rest are Zn and unavoidable impurities.

For another example, Chinese Patent Application CN1398304A, published on Feb. 19, 2003, and titled "STEEL SHEET HOT DIPPED WITH ZN-AL-MG ALLOY HAVING HIGH AL CONTENT", provides a steel sheet hot dipped with a Zn—Al—Mg alloy having a high Al content. In this technical solution, the hot-dipped coating of the steel sheet comprises, in mass %, Al: 10-22%, Mg: 1-5%, Ti: 0.002-0.1%, B: 0.001-0.045%, and Si: 0.005-0.5%. The object of this technical solution is to determine the upper limits of the Al content and the Mg content in the Zn-based hot-dipped coating that can be industrially produced, and it is believed that an Al content of 22% and a Mg content of 5% can also achieve good appearance and low corrosion loss. However, as a matter of fact, there is still room for improvement in the corrosion resistance of the coating by optimizing the design of the coating composition and the coating process.

In addition, it should be noted that for industries such as civil engineering, construction, photovoltaics, agriculture, and animal husbandry, besides the requirement of the coating of a coated steel sheet for corrosion resistance, it's also desired that the coating of the coated steel sheet has higher hardness and good scratch resistance. The coated steel sheet with a coating having high hardness and excellent scratch resistance will greatly facilitate the processing, forming, construction and installation of structural components.

For a zinc-aluminum-magnesium coating, although the coating hardness of the zinc-aluminum-magnesium coating is improved as compared with a pure zinc coating (GI), a difference in the composition design will lead to a large difference in hardness between products. Little attention has been paid to the coating hardness in previous patents. Furthermore, in the zinc-aluminum-magnesium coating, due to the difference in the elongation performance between the phase structures, the coated steel sheet is prone to concentrated large size cracking and coating peeling during use and processing, even during simple bending forming. Even though the zinc-aluminum-magnesium coating has a certain "self-healing" effect, the corrosion resistance of the coating will deteriorate due to the occurrence of large size cracking and peeling.

In view of the above, in order to address the deficiencies existing in the prior art, the present disclosure intends to provide, by reasonable design, a steel sheet continuously hot-dipped with a zinc-aluminum-magnesium-calcium alloy coating having excellent corrosion resistance, scratch resistance and formability, so as to better meet the requirements for use in the fields of construction, civil engineering and home appliances.

SUMMARY

One of the objects of the present disclosure is to provide a steel sheet hot-dipped with a zinc-aluminum-magnesium-calcium alloy coating. The steel sheet hot-dipped with a zinc-aluminum-magnesium-calcium alloy coating has good corrosion resistance as well as excellent scratch resistance and formability. It will bring great convenience to the processing, forming, construction and installation of structural components, and can better meet the requirements for use in the fields of construction, civil engineering and home appliances.

In order to achieve the above object, the present disclosure provides a steel sheet hot-dipped with a zinc-aluminum-magnesium-calcium alloy coating, comprising a steel substrate and an alloy coating on a surface of the steel substrate, wherein the chemical elements of the alloy coating include Zn and unavoidable impurities, and the alloy coating further comprises the following chemical elements in mass percentages:

Al: 12-27%, Mg: 2-8%, Ca: 0.02-5%, Si: 0.15-1.0%;

wherein the mass percentages of Al, Mg and Ca in the alloy coating further satisfy the following relationships: 4%≤(Mg+Ca)≤10%, Al/(Mg+Ca)≥2.5.

Further, in the steel sheet hot-dipped with a zinc-aluminum-magnesium-calcium alloy coating according to the present disclosure, the mass percentages of the chemical elements in the alloy coating are:

Al: 12-27%, Mg: 2-8%, Ca: 0.02-5%, Si: 0.15-1.0%, and a balance of Zn and unavoidable impurities;

wherein the mass percentages of Al, Mg and Ca in the alloy coating further satisfy the following relationships: $4\% \leq (Mg+Ca) \leq 10\%$, $Al/(Mg+Ca) \geq 2.5$.

In one or more embodiments, the mass percentage of Al in the alloy coating is 12%, 12.8%, 13%, 15%, 20%, 20.1%, 21%, 25%, 26.3%, 27% or in a range between any two of the above values.

In one or more embodiments, the mass percentage of Mg in the alloy coating is 2%, 2.5%, 4%, 4.3%, 4.8%, 5%, 7%, 7.5%, 7.8%, 8% or in a range between any two of the above values.

In one or more embodiments, the mass percentage of Ca in the alloy coating is 0.02%, 0.05%, 0.1%, 1%, 2%, 2.3%, 2.5%, 4%, 4.5%, 5% or in a range between any two of the above values.

In one or more embodiments, the mass percentage of Si in the alloy coating is 0.15%, 0.2%, 0.3%, 0.4%, 0.5%, 0.6%, 0.7%, 0.8%, 0.9%, 1.0% or in a range between any two of the above values.

In one or more embodiments, the mass percentages of Mg and Ca in the alloy coating satisfy: (Mg+Ca) is 4%, 5%, 6%, 7%, 8%, 9%, 9.3%, 9.5%, 10% or in a range between any two of the above values.

In one or more embodiments, the mass percentages of Al, Mg and Ca in the alloy coating satisfy: Al/(Mg+Ca) is 2.5, 2.7, 3, 3.2, 3.4, 3.6, 3.8, 4 or in a range between any two of the above values.

In order to achieve the object of the present disclosure, the inventors have optimized the designs of the chemical composition of the alloy coating and the coating process from the perspective of balancing corrosion resistance and processability, thereby obtaining a particular alloy coating structure, and then being able to provide a steel sheet that is continuously hot-dipped with a zinc-aluminum-magnesium-calcium alloy coating and has excellent corrosion resistance, scratch resistance and formability, so as to better meet the requirements for use in the fields of construction, civil engineering, and home appliances.

In the present disclosure, the designed steel substrate is immersed in a plating bath of a zinc-aluminum-magnesium-calcium alloy to form an alloy coating on the surface of the steel substrate, thereby obtaining the steel sheet hot-dipped with the zinc-aluminum-magnesium-calcium alloy coating according to the present disclosure. The chemical composition in the plating liquid can be understood as the chemical composition of the alloy coating.

When designing the chemical composition of the zinc-aluminum-magnesium-calcium alloy coating, the inventors have discovered by research that the Mg content in the alloy coating has room for further increase with the increase of the Al content; the presence of the Ca element has an effect similar to the use of the Mg element, i.e. simultaneously improving the corrosion resistance of the coated steel sheet at flat surfaces and cut edges when added in an amount in an appropriate range; for a coating containing the Mg and Ca elements, the corrosion products are stable and dense, and thus can further delay the development of corrosion; and under appropriate process conditions, the rigid intermetallic compounds of Ca and Mg have a small size, which can not only improve the hardness of the coating, but also enable the coating to achieve excellent scratch resistance, so that they are not easy to become initiating points of large-size cracking during the forming process.

In the steel sheet hot-dipped with a zinc-aluminum-magnesium-calcium alloy coating according to the present disclosure, the chemical elements in the alloy coating are designed according to the following principles:

Al: In the prior art zinc-aluminum-magnesium-calcium alloy coatings, the content of the Al element is usually controlled at around 10%. This is because early reports taught that when the content of the Al element in a coating was further increased to 20%, the corrosion resistance of the coating would be degraded significantly. On the other hand, an increase in the content of the Al element in the coating would also lead to an increase in the plating bath temperature, thereby promoting molten zinc surface oxidation. Moreover, when the Al content in the plating liquid was >8.0%, brittle Fe—Al compounds would increase significantly at the interface between the molten plating liquid and the steel substrate, which would result in poor bonding between the coating and the substrate. Therefore, in the zinc-aluminum-magnesium-calcium alloy coatings designed by the current prior art, the content of Al added was not very high.

Nevertheless, in the present disclosure, the inventors have discovered by research that, under the premise of controlling the surface oxidation of the plating liquid to avoid interference from oxidizing slag, a controlled increase in the content of the Al element in the plating liquid is beneficial to improving the corrosion resistance of the resulting coating, and when Mg, Ca and Al added to the plating liquid are controlled to meet an appropriate ratio, the surface oxidation of the plating liquid can be controlled. However, it should be noted that the content of the Al element in the plating liquid should not be too high. Considering that too high a content of the Al element in the plating liquid will indeed lead to a reduction in the Zn content in the coating and weaken the sacrificial protection of Zn on the Fe substrate, in the present disclosure, the mass percentage of the Al element in the alloy coating is controlled to be in the range of 12-27%.

Accordingly, a certain amount of Si is also added to inhibit the Fe—Al reaction. Preferably, in order to further avoid the influence of the adverse factors, the surface of the plating bath is protected by an inert atmosphere.

Si: In the present disclosure, when designing the zinc-aluminum-magnesium-calcium alloy plating liquid, a controlled amount of the Si element is also added to inhibit the Fe—Al reaction. Just as described above with reference to the design principle of the Al element in the present disclosure, when the content of the Al element in the plating liquid is relatively high (when the Al content is >8.0% as discovered in actual research), a brittle Fe—Al compound increases significantly at the interface between the plating liquid and the substrate. At this time, if the Si element is added to the plating liquid in a small amount, the growth of the Fe—Al compound can be inhibited effectively, which is beneficial to improving the bonding between the alloy coating and the steel substrate.

In addition, it should be noted that the addition of the Si element in a small amount can further inhibit blackening of the alloy coating. However, the content of the Si element added to the zinc-aluminum-magnesium-calcium alloy plating liquid should not be too high. Too high a content of the Si element is not conducive to the occurrence of the Fe—Al reaction on the steel substrate, and will further result in a large amount of slag in the zinc pot. Therefore, in the present disclosure, the mass percentage of the Si element in the resultant alloy coating is controlled to be 0.15-1.0%, and the principle for its addition is Si≈Al×3%.

Accordingly, in the steel sheet hot-dipped with a zinc-aluminum-magnesium-calcium alloy coating according to the present disclosure, when designing the zinc-aluminum-magnesium-calcium alloy plating liquid, in addition to controlling the abovementioned Al and Si elements, the inventors have further controlled the addition of the Ca and Mg elements to the plating liquid. In addition, while controlling the mass percentages of the individual chemical elements, the inventors have further controlled the mass percentages of Al, Mg, and Ca in the alloy coating to satisfy: 4%≤(Mg+Ca)≤10%, Al/(Mg+Ca)≥2.5.

It's well known that the reason why a zinc-aluminum-magnesium coating has good corrosion resistance is that Mg in the coating can uniformly form stable and dense corrosion products with certain fluidity. The existence of the corrosion products enables the cut edges of the steel sheet derived from processing to have a "self-healing" mechanism.

In the present disclosure, the inventors have discovered by research that adding Ca to the plating liquid can have a similar effect as the Mg element in stabilizing corrosion products. During the solidification of the plating liquid, the Al phase forms dendrites first, and intermetallic compounds containing Ca and Mg are introduced into the Zn phase. In a corrosive environment, the Zn phase corrodes first and releases the Ca and Mg elements at the same time, thereby stabilizing the corrosion products more effectively in the early stage of corrosion.

In addition, the inventors have also discovered by research that granular intermetallic compounds formed from the Mg and Ca elements, such as $MgZn_2$, $Mg_2Si$, $Al_2Ca$, $Al_4Ca$, $Al_2CaSi_2$, can improve the hardness of the coating under the premise of proper control, thereby improving the scratch resistance of the coating.

Therefore, the inventors have designed further addition of the Ca and Mg elements. At the same time, considering that it will be detrimental to the surface quality of the coating if the Mg and Ca contents are too high, in the present disclosure, the mass percentage of the Ca element is controlled in the range of 0.02-5%, and the mass percentage of the Si element is controlled in the range of 0.15-1.0%, with 4%≤(Mg+Ca)≤10%.

Accordingly, the reason for controlling Al/(Mg+Ca)≥2.5 is that, when the Al content is 2.5 times or more of (Mg+Ca), the surface oxidation of the plating bath and the coating can be better controlled.

Further, in the steel sheet hot-dipped with a zinc-aluminum-magnesium-calcium alloy coating according to the present disclosure, the alloy coating may further comprise either or both of Ti: 0.01-0.1% and B: 0-0.05%.

In one or more embodiments, the mass percentage of Ti in the alloy coating is 0, 0.01%, 0.02%, 0.03%, 0.04%, 0.05%, 0.06%, 0.07%, 0.08%, 0.09%, 0.1% or in a range between any two of the above values.

In one or more embodiments, the mass percentage of B in the alloy coating is 0, 0.001%, 0.005%, 0.01%, 0.02%, 0.03%, 0.04%, 0.05% or in a range between any two of the above values.

In the steel sheet hot-dipped with a zinc-aluminum-magnesium-calcium alloy coating designed according to the present disclosure, when the steel substrate is immersed in the plating bath of the zinc-aluminum-magnesium-calcium alloy, the Ti and B elements may also be added to the plating liquid. When the plating liquid contains the Ti and B elements, the coating structure can be further refined. These two elements may exist independently or as a composite in the plating liquid.

However, it should be noted that the contents of the Ti and B elements in the plating liquid should not be too high. When the Ti and B contents are too high, Ti—Al, Al—B, and Ti—B based precipitates will be generated in the coating, and fine particles will be produced on the coating, leading to aesthetic defects of the coated steel sheet. Therefore, in the present disclosure, by controlling the alloy components in the plating liquid, it is possible to control the alloy coating to contain either or both of Ti: 0.01-0.1% and B: 0-0.05%. Further, in the steel sheet hot-dipped with a zinc-aluminum-magnesium-calcium alloy coating according to the present disclosure, the microstructure of the alloy coating comprises: an Al-rich phase, a $MgZn_2$ phase, a Zn-rich phase and a $Mg_2Si$ phase, and a granular intermetallic compound enriched with the Mg and Ca elements.

Further, in the steel sheet hot-dipped with a zinc-aluminum-magnesium-calcium alloy coating according to the present disclosure, the granular intermetallic compound includes at least one of the following: $MgZn_2$, $Mg_2Si$, $Al_2Ca$, $Al_4Ca$, $Al_2CaSi_2$, $Ca_3Zn$.

Further, in the steel sheet hot-dipped with a zinc-aluminum-magnesium-calcium alloy coating according to the present disclosure, the hardness of the alloy coating is 140-240 Hv, for example, 160 Hv, 180 Hv, 200 Hv, and 220 Hv.

In the steel sheet hot-dipped with a zinc-aluminum-magnesium-calcium alloy coating according to the present disclosure, a single-sided coating amount of the alloy coating may be 120-300 g/m$^2$, for example, 130 g/m$^2$, 140 g/m$^2$, 150 g/m$^2$, 160 g/m$^2$, 200 g/m$^2$, 300 g/m$^2$.

Accordingly, another object of the present disclosure is to provide a method for manufacturing the abovementioned steel sheet hot-dipped with a zinc-aluminum-magnesium-calcium alloy coating, by which a steel sheet continuously hot-dipped with a zinc-aluminum-magnesium-calcium alloy coating having excellent corrosion resistance, scratch resistance and formability can be obtained.

In order to achieve the above object, the present disclosure proposes a method for manufacturing the abovementioned steel sheet hot-dipped with a zinc-aluminum-magnesium-calcium alloy coating, comprising steps of:

(1) immersing a steel substrate annealed in a non-oxidizing atmosphere in a plating liquid of a zinc-aluminum-magnesium-calcium alloy;

(2) removing a coated strip steel from a plating bath; subjecting the coated strip steel to gas jet cooling using a cooling jet box, with a cooling rate controlled to be ≥10° C./s, until a temperature of the coated strip steel is lower than 100° C.; and then placing the coated strip steel in a water quenching tank for water cooling.

In one or more embodiments, in step (2), the cooling rate is 10° C./s, 15° C./s, 20° C./s, 25° C./s, 30° C./s, 35° C./s, 40° C./s or in a range between any two of the above values.

In the manufacturing method according to the present disclosure, firstly, there is no special limitation on the composition of the steel substrate or the process used for the steel sheet hot-dipped with a zinc-aluminum-magnesium-calcium alloy coating according to the present disclosure. Operators can select arbitrarily a desired cold-rolled or hot-rolled substrate in light of the target use of the product.

Accordingly, in a practical preparation process, an operator needs to immerse a steel substrate, which has been annealed in a non-oxidizing atmosphere, in a designed plating liquid of a zinc-aluminum-magnesium-calcium alloy in a plating bath to obtain an alloy coating solidified on the surface of the steel substrate. In order to guarantee the quality of the coating, when the steel sheet is immersed in the plating liquid, the relationship between the steel sheet temperature ($T_{Fe}$) and the plating liquid temperature ($T_{Zn}$) may be further optimized and controlled to satisfy ($T_{Zn}$−5° C.)≤$TF_e$≤($T_{Zn}$+20° C.).

It should be noted that in order to guarantee the plating quality, it's most preferred to cover the surface of the plating bath with a sealing housing and protect the surface of the plating bath with an inert atmosphere. The atmosphere inside the sealing housing may be controlled to be: an inert gas with ≤3% by volume of $O_2$.

When the coated strip steel is removed from the plating bath, in order to avoid oxidation of Mg and Ca on the coating surface, the coating surface needs to be cooled in time. In the present disclosure, several stages of cooling jet boxes are used specifically to perform gas jet cooling on the coated strip steel, and the cooling rate is controlled to be ≥10° C./s until the temperature of the coated strip steel is lower than 100° C. In addition, a fast cooling rate is also conducive to formation of a uniform coating structure, and the cracks formed during deformation are more uniform and finer as compared with a slowly cooled sample. The arrangement of the cooling jet boxes may start from 2 to 4 m from the surface of the alloy plating liquid and end at the top roller, and may be divided into three to eight stages as desired, such as three, four, five, six, seven, and eight stages.

Further, in the manufacturing method according to the present disclosure, in step (1), the temperature of the plating liquid of the zinc-aluminum-magnesium-calcium alloy is 460-560° C., for example, 470° C., 480° C., 490° C., 500° C., 510° C., 520° C., 530° C., 540° C., 550° C.

In the above technical solution according to the present disclosure, the temperature of the plating liquid in the plating bath containing the plating liquid of the zinc-aluminum-magnesium-calcium alloy may be adjusted depending on the composition of the plating liquid, and is controlled specifically in the range of 460-560° C.

In the present disclosure, a cold-rolled or hot-rolled substrate (i.e., a steel substrate) needs to be immersed in a designed plating liquid of a zinc-aluminum-magnesium-calcium alloy. Since a difference in the composition of the zinc-aluminum-magnesium-calcium coating will lead to a difference in the actual solidification point, the temperature of the plating liquid is set in principle to be 40-50° C. higher than the solidification point of the coating. Therefore, with the variation in the composition of the plating liquid (equivalent to the coating composition) taken into account, the temperature of the plating liquid is set in the range of 460-560° C. When the temperature of the plating liquid is too low, a desirable Fe—Al reaction layer cannot be formed, affecting the bonding strength between the coating and the substrate; when the temperature of the plating liquid is too high, the Fe—Al reaction will be too strong, and the alloy coating will be too thick, such that a desirable bonding between the coating and the substrate cannot be obtained either.

Further, in the manufacturing method according to the present disclosure, in step (1), when the steel substrate is immersed in the plating liquid of the zinc-aluminum-magnesium-calcium alloy, the relationship between the temperature of the steel substrate $T_{Fe}$ and the temperature of the plating liquid of the zinc-aluminum-magnesium-calcium alloy $T_{Zn}$ is controlled to satisfy: ($T_{Zn}$−5° C.)≤$T_{Fe}$≤($T_{Zn}$+20° C.).

In the manufacturing method according to the present disclosure, in step (1), the steel substrate may be immersed in the plating liquid for a time period of 1-5 seconds, for example, 2 seconds, 3 seconds, or 4 seconds.

Further, in the manufacturing method according to the present disclosure, before the coated strip steel is cooled to a temperature of 340° C., the cooling gas jetted from the cooling jet box is $N_2$ with ≤3% by volume of $O_2$ compressed at ambient temperature.

In the above technical solution according to the present disclosure, before the coated strip steel is cooled to a temperature of 340° C., a sealing box is arranged for the strip steel between the cooling jet box and the plating bath, and inert atmosphere protection is also employed. The atmosphere inside the sealing box may be controlled to be: an inert gas with ≤3% by volume of $O_2$. If the inert atmosphere protection does not exist, the surface quality of the coating will decline, and a small amount of aesthetic defects such as "transverse fine lines" and "point-like particles" tend to appear. However, minor defects do not affect the corrosion resistance, scratch resistance, or formability of the coating, and do not affect the application of the highly corrosion-resistant coating in the fields of construction and civil engineering.

Further, in the manufacturing method according to the present disclosure, in step (2), the temperature of the coated strip steel when it reaches the top roller is controlled to be ≤250° C., for example, 100° C., 120° C., 130° C., 140° C., 150° C., 160° C., 170° C., 180° C., 190° C., 200° C., 210° C., 220° C., 230° C., 240° C.

Further, in the manufacturing method according to the present disclosure, the first-stage cooling jet box is set at a height of 2-4 m, for example, 2.5 m, 3 m, or 3.5 m, from the surface of the plating liquid of the zinc-aluminum-magnesium-calcium alloy in the plating bath.

Further, in the manufacturing method according to the present disclosure, the surface of the plating bath is covered with a sealing housing, and the atmosphere inside the sealing housing is: an inert gas with ≤3% by volume of $O_2$.

Further, in the manufacturing method according to the present disclosure, the coated strip steel between the first-stage cooling jet box and the plating bath is protected using a sealing box.

Compared with the prior art, the steel sheet hot-dipped with a zinc-aluminum-magnesium-calcium alloy coating according to the present disclosure and the manufacturing method thereof have the following advantages and beneficial effects:

In the present disclosure, the inventors have optimized the designs of the chemical composition of the alloy coating and the coating process from the perspective of balancing corrosion resistance and processability, thereby obtaining a particular alloy coating structure, and then being able to provide a steel sheet that is continuously hot-dipped with a zinc-aluminum-magnesium-calcium alloy coating and has excellent corrosion resistance, scratch resistance and formability, which will greatly facilitate the processing, forming, construction and installation of structural components, so as to better meet the requirements for use in the fields of construction, civil engineering, and home appliances.

In the present disclosure, the excellent performances of the prepared steel sheet hot-dipped with a zinc-aluminum-magnesium-calcium alloy coating are embodied by the alloy coating of which the design has been optimized. The surface quality of the alloy coating is excellent, and the alloy coating is well bonded to the substrate. In the cyclic accelerated corrosion test in accordance with ISO 14993-2018 under the condition of the same coating amount, the time periods corresponding to the occurrence of 5% red rust on the alloy coating of the steel sheet hot-dipped with a zinc-aluminum-magnesium-calcium alloy coating according to the present disclosure at the flat surface, cut edge, and T-bend can all reach 10-20 times that of the hot-dip galvanized steel sheet GI; at the same time, the hardness of the alloy coating is as high as 140-240 Hv, which is 2-4 times that of the hot-dip galvanized steel sheet GI, suggesting good application prospects.

DETAILED DESCRIPTION

Figure 1:
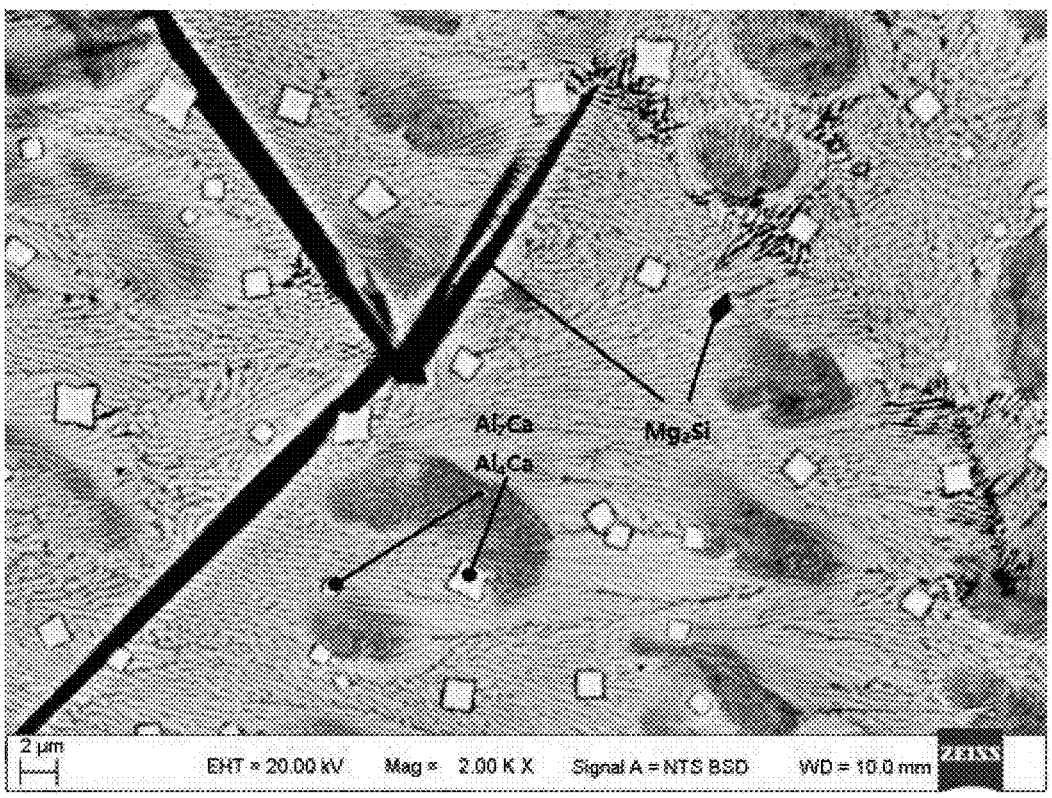
FIG. 1 is an electron microscope photograph showing the surface of the alloy coating of the steel sheet hot-dipped with a zinc-aluminum-magnesium-calcium alloy coating in Example 1.

The steel sheet hot-dipped with a zinc-aluminum-magnesium-calcium alloy coating according to the present disclosure and the manufacturing method thereof will be further explained and illustrated below with reference to the specific Examples and the drawings of the specification. However, such explanation and illustration do not constitute an improper limitation on the technical solution of the present disclosure.

Examples 1-10 and Comparative Examples 1-10

For the steel sheet hot-dipped with a zinc-aluminum-magnesium-calcium alloy coating according to the present disclosure, the inventors have imposed no special restrictions on the composition or process for the steel substrate, and those skilled in the art can arbitrarily select a cold-rolled or hot-rolled substrate in light of the target use of the product.

The steel sheets hot-dipped with the zinc-aluminum-magnesium-calcium alloy coatings in Examples 1-10 and the comparative steel sheets in Comparative Examples 1-10 were all prepared by the following steps:

(1) A low-carbon Al-killed steel cold-rolled sheet having a substrate thickness of 0.8 mm was used as a steel substrate. The steel substrate annealed in a non-oxidizing atmosphere was sent into a plating bath, and immersed in a plating liquid of a zinc-aluminum-magnesium-calcium alloy having one of the various compositions as shown in Table 1. The temperature of the plating liquid of the zinc-aluminum-magnesium-calcium alloy was controlled to be 460-560° C. When the steel substrate was immersed in the plating liquid of the zinc-aluminum-magnesium-calcium alloy, the relationship between the temperature of the steel substrate $T_{Fe}$ and the temperature of the plating liquid of the zinc-aluminum-magnesium-calcium alloy $T_{Zn}$ was controlled to satisfy: $(T_{Zn}-5° C.) \leq T_{Fe} \leq (T_{Zn}+20° C.)$. The steel substrate was lifted up after being immersed in the plating liquid for 3 seconds. A sealing housing was arranged on the surface of the plating bath to cover it, and the atmosphere inside the sealing housing was controlled to be: an inert gas with ≤3% by volume of $O_2$.

(2) After the coated strip steel was removed from the plating bath, the coated strip steel was firstly subjected to gas jet cooling using a cooling jet box. The height of the first-stage cooling jet box was controlled to be 2-4 m from the surface of the plating liquid of the zinc-aluminum-magnesium-calcium alloy in the plating bath. The coated strip steel between the first-stage cooling jet box and the plating bath was protected using a sealing box. The temperature of the coated strip steel when it reached the top roller was controlled to be ≤250° C., and the cooling rate was controlled to be ≥10° C./s, until the temperature of the coated strip steel was lower than 100° C. Then, the coated strip steel was placed in a water quenching tank for water cooling, so as to obtain a coated strip steel with a single-sided coating amount of 140 g/m$^2$;

wherein before the coated strip steel was cooled to a temperature of 340° C., the cooling gas was ambient-temperature compressed $N_2$, and the volume content of $O_2$ therein was controlled to be ≤3%. After the coated strip steel was cooled to a temperature of 340° C., the above special control was no longer performed, and the cooling gas jetted from the remaining cooling jet boxes was ambient-temperature compressed air.

In the present disclosure, for evaluating the influence of the coating composition on the corrosion resistance of the steel sheet, the inventors prepared several steel sheets hot-dipped with zinc-aluminum-magnesium-calcium alloy coatings, which had the same coating amount (i.e., a single-sided coating amount of 140 g/m$^2$), but obtained by plating with plating liquids of different compositions.

It should be noted that in the present disclosure, the chemical compositions of the alloy coatings used for the steel sheets hot-dipped with the zinc-aluminum-magnesium-calcium alloy coatings in Examples 1-10 and the related processes implemented all meet the design specification requirements of the present disclosure.

However, the comparative steel sheets in Comparative Examples 1-10 do not meet the requirements of the present disclosure in terms of the chemical composition design of the alloy coating and/or the design of the process parameters. Comparative Example 10 listed is the GI reference.

Table 1 lists the mass percentages of the various chemical elements in the zinc-aluminum-magnesium-calcium alloy plating liquids used for the steel sheets hot-dipped with the zinc-aluminum-magnesium-calcium alloy coatings in Examples 1-10 and the comparative steel sheets in Comparative Examples 1-10.

TABLE 1

Mass percentages of the chemical elements in the zinc-aluminum-magnesium-calcium alloy plating liquids used in the Examples and Comparative Examples (the balance is Zn and unavoidable impurities)

| No. | Al (wt %) | Si (wt %) | Mg (wt %) | Ca (wt %) | Ti (wt %) | B (wt %) | Mg + Ca (wt %) | Al/(Mg + Ca) (wt %) |
|---|---|---|---|---|---|---|---|---|
| Ex. 1 | 12.8 | 0.2 | 2.5 | 2.5 | 0 | 0 | 5.00 | 2.56 |
| Ex. 2 | 20.1 | 0.4 | 2.5 | 4.5 | 0.01 | 0 | 7.00 | 2.87 |
| Ex. 3 | 20.1 | 0.6 | 4.3 | 2.3 | 0.01 | 0.01 | 6.60 | 3.05 |
| Ex. 4 | 20.1 | 0.6 | 4.3 | 2.3 | 0.01 | 0.03 | 6.60 | 3.05 |
| Ex. 5 | 20.1 | 0.6 | 4.3 | 2.3 | 0.03 | 0.03 | 6.60 | 3.05 |
| Ex. 6 | 20.1 | 0.5 | 7.5 | 0.02 | 0.01 | 0 | 7.52 | 2.67 |
| Ex. 7 | 20.1 | 0.5 | 7.5 | 0.02 | 0.05 | 0 | 7.52 | 2.67 |
| Ex. 8 | 26.3 | 0.8 | 2.5 | 4.5 | 0.01 | 0.04 | 7.00 | 3.76 |
| Ex. 9 | 26.3 | 0.8 | 4.8 | 4.5 | 0.07 | 0.04 | 9.30 | 2.83 |
| Ex. 10 | 26.3 | 0.8 | 7.8 | 0.05 | 0.09 | 0 | 7.85 | 3.35 |
| Comp. Ex. 1 | 6.3 | 0.2 | 2.5 | 2.5 | 0 | 0 | 5.00 | 1.26 |
| Comp. Ex. 2 | 12.8 | 0.4 | 1.5 | 0.05 | 0.01 | 0.02 | 1.55 | 8.26 |
| Comp. Ex. 3 | 20.1 | 0.6 | 0.0 | 4.5 | 0.01 | 0 | 4.50 | 4.47 |
| Comp. Ex. 4 | 20.1 | 0.6 | 4.3 | 2.3 | 0.01 | 0.07 | 6.60 | 3.05 |
| Comp. Ex. 5 | 20.1 | 0.6 | 7.5 | 0.02 | 0.15 | 0 | 7.52 | 2.67 |
| Comp. Ex. 6 | 26.3 | 0.8 | 4.8 | 4.5 | 0.01 | 0 | 9.30 | 2.83 |
| Comp. Ex. 7 | 26.3 | 0.8 | 7.8 | 2.8 | 0.01 | 0 | 10.60 | 2.48 |
| Comp. Ex. 8 | 26.3 | 0.8 | 7.8 | 2.8 | 0.01 | 0 | 10.60 | 2.48 |
| Comp. Ex. 9 | 38.5 | 1.0 | 2.5 | 1.0 | 0.01 | 0 | 3.50 | 11.00 |
| Comp. Ex. 10 | 0.02 | 0 | 0 | 0 | 0 | 0 | 0 | 0 |

In the present disclosure, the steel substrate was immersed in a plating liquid of a zinc-aluminum-magnesium-calcium alloy for plating, and an alloy coating was formed on the surface of the steel substrate. Therefore, the chemical composition of a plating liquid of a zinc-aluminum-magnesium-calcium alloy in Table 1 above can be understood to be equivalent to the chemical composition of the alloy coating formed in the corresponding Example or Comparative Example.

TABLE 2

Specific process parameters used in the process steps for the Examples and Comparative Examples

| No. | Steel substrate temperature (° C.) | Zinc-aluminum-magnesium-calcium alloy plating liquid temperature (° C.) | Atmosphere protection | Distance from first-stage cooling jet box to zinc-aluminum-magnesium-calcium alloy plating liquid surface (m) | Temperature of coated strip steel arriving at top roller (° C.) | Cooling rate (° C./s) |
|---|---|---|---|---|---|---|
| Ex. 1 | 485 | 490 | Yes | 2 | 170 | 30 |
| Ex. 2 | 505 | 510 | Yes | 4 | 200 | 15 |
| Ex. 3 | 505 | 510 | Yes | 4 | 180 | 30 |
| Ex. 4 | 515 | 510 | Yes | 3 | 230 | 10 |
| Ex. 5 | 515 | 510 | No | 3 | 235 | 10 |
| Ex. 6 | 515 | 510 | Yes | 4 | 220 | 20 |
| Ex. 7 | 520 | 510 | Yes | 3 | 220 | 20 |
| Ex. 8 | 525 | 530 | No | 2 | 240 | 25 |
| Ex. 9 | 525 | 530 | Yes | 2 | 240 | 25 |
| Ex. 10 | 565 | 550 | Yes | 4 | 230 | 25 |
| Comp. Ex. 1 | 450 | 430 | Yes | 4 | 170 | 25 |
| Comp. Ex. 2 | 495 | 490 | Yes | 5 | 160 | 30 |
| Comp. Ex. 3 | 510 | 510 | Yes | 3 | 190 | 15 |
| Comp. Ex. 4 | 510 | 510 | Yes | 3 | 200 | 20 |
| Comp. Ex. 5 | 505 | 510 | Yes | 4 | 180 | 20 |
| Comp. Ex. 6 | 590 | 580 | No | 10 | 250 | 25 |
| Comp. Ex. 7 | 525 | 530 | No | 10 | 220 | 25 |
| Comp. Ex. 8 | 525 | 530 | Yes | 6 | 200 | 25 |
| Comp. Ex. 9 | 560 | 550 | No | 6 | 220 | 30 |
| Comp. Ex. 10 | 450 | 460 | No | 10 | 170 | 25 |

Table 2 lists the specific process parameters in the above process steps for the steel sheets hot-dipped with the zinc-aluminum-magnesium-calcium alloy coatings in Examples 1-10 and the comparative steel sheets in Comparative Examples 1-10.

Note: In Table 2 above, "atmosphere protection" means that in step (2), before the coated strip steel was cooled to a temperature of 340° C., a sealing box was arranged between the cooling jet box and the plating bath, and the atmosphere inside the sealing box was controlled to be: an inert gas with ≤3% by volume of $O_2$.

In order to verify the implementation effectiveness of this case and prove the superior effects of this case over the prior art, the alloy coatings of the steel sheets hot-dipped with the zinc-aluminum-magnesium-calcium alloy coatings obtained in Examples 1-10 and the alloy coatings of the comparative steel sheets obtained in Comparative Examples 1-10 were analyzed and tested. Table 3 lists the analysis and test results of the alloy coatings of the Examples and Comparative Examples.

The relevant analysis and test methods are as follows:

(1) The coating surface quality was rated by observing with naked eyes the number of defects such as "transverse fine lines", "zinc ash", and "zinc slag" on the alloy coating surfaces in the Examples and Comparative Examples. The evaluation criteria are as follows:

Evaluation ◎: No obvious defects;

Evaluation ○: number of defects ≤4/100 m;

Evaluation Δ: number of defects 5-10/100 m;

Evaluation x: number of defects >10/100 m.

In summary, when the coating surface quality was evaluated as "◎" or "○", it's considered to be able to meet the surface quality control requirement of the present disclosure.

(2) From the coated steel sheets obtained in Examples 1-10 and Comparative Examples 1-10, 120×200 mm samples of the Examples and Comparative Examples were taken respectively, and 1800 0T bending was performed. A tape was applied and then peeled off. Dezincification was observed with naked eyes to evaluate the bonding strength between the coating and the substrate. The evaluation criteria are as follows:

Evaluation ◎: no peeling from the coating;

Evaluation ○: 1-2 peeling points on the tape visible to naked eyes;

Evaluation Δ: 3-10 peeling points on the tape visible to naked eyes;

Evaluation x: peeling points >10, or peeling off in pieces from the coating.

In summary, when the T-bend adhesion evaluation was "©" or "o", it's considered to be able to meet the coating bonding strength requirement of the present disclosure.

(3) For the steel sheets hot-dipped with the zinc-aluminum-magnesium-calcium alloy coatings in Examples 1-10 and the comparative steel sheets in Comparative Examples 1-10 prepared under different composition and process conditions, the coated steel sheet of each of the Examples and Comparative Examples was cut into a sample of 150×70 mm in size.

According to the accelerated test standard for cyclic exposure of metals and alloys to salt mist, dry and wet conditions as specified in ISO 14993-2018, the corrosion resistance of the samples of the Examples and Comparative Examples at the flat surface, cut edge and T-bend was tested, and the number of cycles corresponding to the occurrence of 5% red rust on the coating surface, cut edge and T-bend under different conditions was recorded. The GI coating (pure zinc coating) having a single-sided coating amount of 140 g/$m^2$ in Comparative Example 10 was used as a reference, and the multiple by which the corrosion resistance of the alloy coating of the coated steel sheet in each of Examples 1-10 and Comparative Examples 1-9 was increased relative to the GI coating (pure zinc coating) in Comparative Example 10 was calculated.

In addition, the alloy coating of the coated steel sheet in each of the Examples and Comparative Examples was further tested. The coating hardness was tested according to the method specified in GB/T 9790-2021 "Metallic materials—Vickers and Knoop microhardness tests of metallic and other inorganic coatings", with a load of 100 gf used to test the coating hardness $H_{v100g}$ of each of the Examples and Comparative Examples.

Table 3 lists the analysis and test results of the alloy coatings of the steel sheets hot-dipped with the zinc-aluminum-magnesium-calcium alloy coatings in Examples 1-10 and the comparative steel sheets in Comparative Examples 1-10.

TABLE 3

Analysis and test results of alloy coatings in Examples and Comparative Examples

| | | | Number of cycles for red rust at flat surface | | Number of cycles for red rust at cut edge | | Number of cycles for red rust at 0T bend | | Coating hardness | |
|---|---|---|---|---|---|---|---|---|---|---|
| No. | Coating surface quality | T bend adhesion | Cycles | Multiple relative to Comp. Ex. 10 reference | Cycles | Multiple relative to Comp. Ex. 10 reference | Cycles | Multiple relative to Comp. Ex. 10 reference | $Hv_{100g}$ | Multiple relative to Comp. Ex. 10 reference |
| Ex. 1 | ◎ | ◎ | 210 | 10.5 | 200 | 13.3 | 180 | 12.0 | 145 | 2.2 |
| Ex. 2 | ◎ | ◎ | 260 | 13.0 | 220 | 14.7 | 230 | 15.3 | 160 | 2.5 |
| Ex. 3 | ◎ | ◎ | 280 | 14.0 | 230 | 15.3 | 220 | 14.7 | 200 | 3.1 |
| Ex. 4 | ◎ | ○ | 260 | 13.0 | 230 | 15.3 | 200 | 13.3 | 210 | 3.1 |
| Ex. 5 | ○ | ○ | 260 | 13.0 | 230 | 15.3 | 190 | 12.7 | 200 | 3.1 |
| Ex. 6 | ◎ | ◎ | 300 | 15.0 | 250 | 16.7 | 250 | 16.7 | 240 | 3.7 |
| Ex. 7 | ◎ | ◎ | 300 | 15.0 | 260 | 17.3 | 245 | 16.3 | 235 | 3.6 |
| Ex. 8 | ◎ | ○ | 320 | 16.0 | 290 | 19.3 | 310 | 20.7 | 180 | 2.8 |
| Ex. 9 | ◎ | ◎ | 320 | 16.0 | 300 | 20.0 | 300 | 20.0 | 200 | 3.1 |
| Ex. 10 | ◎ | ◎ | 300 | 15.0 | 210 | 14.0 | 230 | 15.3 | 230 | 3.5 |
| Comp. Ex. 1 | × | × | 130 | 6.5 | 130 | 8.7 | 70 | 4.7 | 120 | 1.8 |
| Comp. Ex. 2 | ◎ | ◎ | 120 | 6.0 | 100 | 6.7 | 80 | 5.3 | 130 | 2.0 |

TABLE 3-continued

Analysis and test results of alloy coatings in Examples and Comparative Examples

| No. | Coating surface quality | T bend adhesion | Number of cycles for red rust at flat surface | | Number of cycles for red rust at cut edge | | Number of cycles for red rust at 0T bend | | Coating hardness | |
|---|---|---|---|---|---|---|---|---|---|---|
| | | | Cycles | Multiple relative to Comp. Ex. 10 reference | Cycles | Multiple relative to Comp. Ex. 10 reference | Cycles | Multiple relative to Comp. Ex. 10 reference | $Hv_{100g}$ | Multiple relative to Comp. Ex. 10 reference |
| Comp. Ex. 3 | ◎ | ◎ | 220 | 11.0 | 200 | 13.3 | 200 | 13.3 | 105 | 1.6 |
| Comp. Ex. 4 | Δ | ○ | 180 | 9.0 | 150 | 10.0 | 130 | 8.7 | 180 | 2.8 |
| Comp. Ex. 5 | Δ | Δ | 250 | 12.5 | 200 | 13.3 | 220 | 14.7 | 220 | 3.4 |
| Comp. Ex. 6 | X | X | 310 | 15.5 | 280 | 18.7 | 300 | 20.0 | 190 | 2.9 |
| Comp. Ex. 7 | X | X | 280 | 14.0 | 200 | 13.3 | 120 | 8.0 | 240 | 3.7 |
| Comp. Ex. 8 | Δ | Δ | 320 | 16.0 | 250 | 16.7 | 200 | 13.3 | 240 | 3.7 |
| Comp. Ex. 9 | ◎ | ◎ | 280 | 14.0 | 80 | 5.3 | 160 | 10.7 | 130 | 2.0 |
| Comp. Ex. 10 | ◎ | ◎ | 20 | 1 | 15 | 1 | 15 | 1 | 65 | 1 |

As it can be seen from Table 3, in the present disclosure, the alloy coatings of the steel sheets hot-dipped with the zinc-aluminum-magnesium-calcium alloy coatings obtained in Examples 1-10 all had excellent surface quality, and the coatings were well bonded to the substrates. The coating surface quality evaluation results and T-bend adhesion evaluation results were all "©" or "o", meeting the requirements of the present disclosure.

In addition, it's not difficult to see from the comparative tests of Examples 1-10 and the GI reference (Comparative Example 10) for corrosion resistance that the alloy coatings of the steel sheets hot-dipped with the zinc-aluminum-magnesium-calcium alloy coatings in Examples 1-10 according to the present disclosure exhibited larger cycle numbers in the corrosion resistance test at the flat surface, cut edge and T-bend, indicating better corrosion resistance. The cycle number corresponding to the occurrence of 5% red rust on the flat surface was 10.5-16 times that of the GI reference; the cycle number corresponding to the occurrence of 5% red rust on the cut edge was 13.3-20 times that of the GI reference; and the cycle number corresponding to the occurrence of 5% red rust on the 0T bend was 12-20.7 times that of the GI reference.

In addition, the alloy coatings of the steel sheets hot-dipped with the zinc-aluminum-magnesium-calcium alloy coatings in Examples 1-10 also exhibited higher coating hardness which was 2.2-3.7 times that of the GI reference, indicating excellent scratch resistance.

In Comparative Example 1 designed in the present disclosure, the content of the Al element in the coating was rather low (6.3%), and the corrosion resistance of the coating at the flat surface was only 6.5 times that of the GI reference. In addition, its Al/(Mg+Ca) value was rather low, and the coating surface quality was poor. In contrast, in Example 1, the (Mg+Ca) content remained unchanged relative to Comparative Example 1, while the content of the Al element in the coating was increased to 12.8%. As a result, the corrosion resistance of the coating at the flat surface reached 10.5 times that of the GI reference, and the corrosion resistance at both the cut edge and 0T bend was improved, also indicating good surface quality.

In Example 2, the content of the Al element in the coating was increased to 20.1%, and the upper limit of the (Mg+Ca) content in the plating liquid was increased accordingly, which could not only improve the corrosion resistance of the coating, but also provide better coating surface quality. In addition, the hardness and scratch resistance of the coating were also increased with the increase of intermetallic compound forming elements such as Mg and Ca. However, in Comparative Example 9, the content of the Al element in the coating was further increased to 38.5% such that the content of the Al element was too high. Although the corrosion resistance of the finally resulting coating at the flat surface was still good, the corrosion resistance of the coating at the cut edge dropped sharply, with the cycle number for the red rust at the cut edge of the coating being only 5.3 times that of the GI reference.

As it can be seen from Comparative Example 2, although the Al content in the coating was 12.8%, the total amount of (Mg+Ca) was relatively low, only 1.55%, which also affected the corrosion resistance of the coating, especially the corrosion resistance at the cut edge and bend. The overall performance was even worse than the coating in Comparative Example 1. In Example 1, the total amount of (Mg+Ca) in the coating reached 5%, and the corrosion resistance of the coating was improved significantly. However, as it can be seen from Comparative Example 8, when the (Mg+Ca) content in the coating exceeded the range defined by the present disclosure, it would be difficult to obtain good coating surface quality. Under the premise of atmosphere protection, the corrosion resistance of the coating was acceptable, but the surface defects of the coating had increased. In Comparative Example 7, under the same preparation conditions but without $N_2$ protection, the surface quality of the coating degraded seriously, and the corrosion resistance of the coating, especially the corrosion resistance at the T-bend processing area, was reduced seriously due to the large-scale cracking and peeling caused by defects. As it can be seen from a comparison between Example 5 and Example 4, when there was no atmosphere protection, the surface quality of the coating was somewhat decreased than that under inert atmosphere protection conditions, and the "transverse fine lines" on the coating surface increased somewhat, but there was no significant influence on the other performances.

As it can be seen from Comparative Example 3, when designing the coating, even with no addition of the Mg element, adding Ca alone also played a good role in improving the corrosion resistance, but the effect of adding the Ca element alone on improving the hardness of the coating was limited. The hardness of the coating was only 105 Hv, still far from the scratch resistance desired by the present disclosure. In contrast, in Example 3, while the total amount of (Mg+Ca) in the coating was not much different, further addition of the Mg element to the coating contributed more to the improvement of the hardness of the coating.

In Example 4, 0.03% B was further added on the basis of Example 3, and it had no significant influence on the surface quality or corrosion resistance of the coating. However, in Comparative Example 4, the B element was added in an excessive amount, which increased the defects on the coating surface, thereby affecting the corrosion resistance. The effect of the Ti element was the same. Compared with Example 7, in Comparative Example 5, Ti was added in an excessive amount, which caused a large number of defects on the coating surface, thereby reducing the corrosion resistance to a certain extent while affecting the aesthetic appearance. Therefore, although both of them had a certain effect of refining the structure, the amount added should be selected judiciously within the range specified in the present disclosure.

In addition, as it can be seen from Comparative Example 6, the temperature of the plating liquid of the zinc-aluminum-magnesium-calcium alloy in Comparative Example 6 didn't meet the design requirement of the present disclosure. When the temperature of the plating liquid of the zinc-aluminum-magnesium-calcium alloy was too high, the Fe—Al inhibiting layer was significantly thickened. Moreover, without post-plating atmosphere protection, the surface quality of the coating was seriously affected. Although these surface defects had little influence on the corrosion resistance of the flat surface of the coating, severe cracking and peeling of the coating were observed at the 0T bend, and the corrosion resistance of the deformed parts was deteriorated seriously.

FIG. 1 is an electron microscope photograph showing the surface of the alloy coating of the steel sheet hot-dipped with a zinc-aluminum-magnesium-calcium alloy coating in Example 1.

In the present disclosure, the surface morphology of the alloy coating of the steel sheet hot-dipped with a zinc-aluminum-magnesium-calcium alloy coating obtained in Example 1 is shown in FIG. 1. In this embodiment, the addition of the Ca element led to the formation of white "star"-shaped intermetallic compound particles of $Al_2Ca$ and $Al_4Ca$ on the surface of the alloy coating, and the Mg element also formed black $Mg_2Si$ particles.

Figure 2:
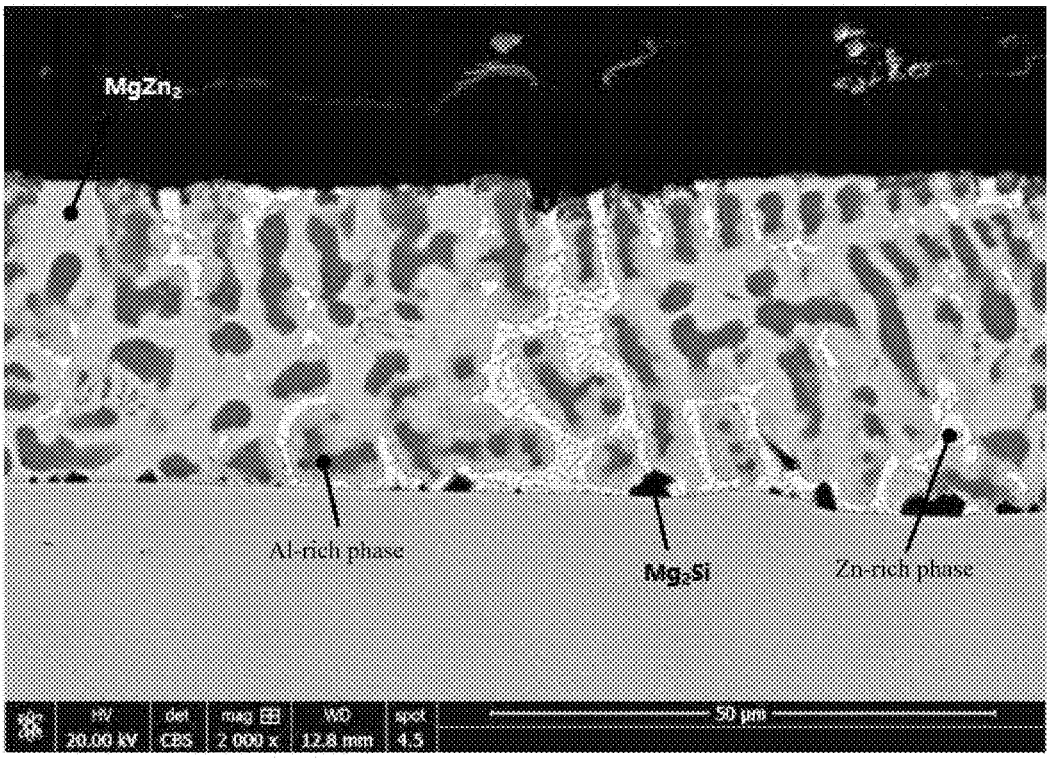
FIG. 2 is an electron microscope photograph showing the cross-section of the alloy coating obtained by rapid cooling the steel sheet hot-dipped with a zinc-aluminum-magnesium-calcium alloy coating in Example 3.

FIG. 2 is an electron microscope photograph showing the cross-section of the alloy coating obtained by rapid cooling the steel sheet hot-dipped with a zinc-aluminum-magnesium-calcium alloy coating in Example 3.

Figure 3:
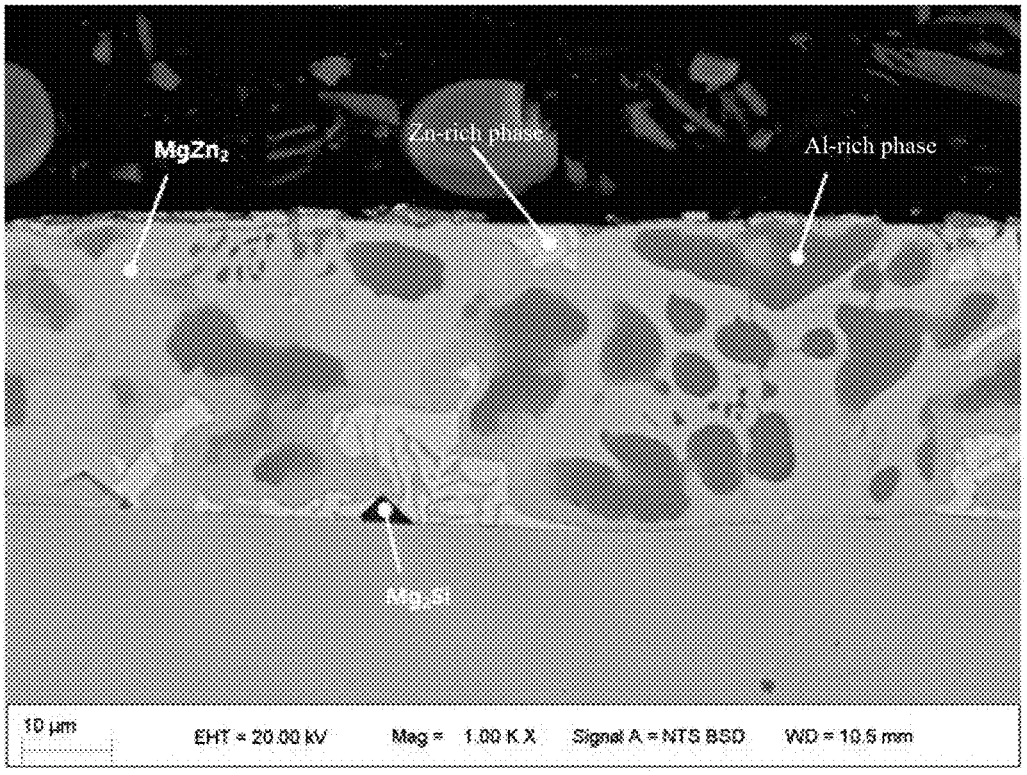
FIG. 3 is an electron microscope photograph showing the cross-section of the alloy coating obtained by slowly cooling the steel sheet hot-dipped with a zinc-aluminum-magnesium-calcium alloy coating in Example 4.

FIG. 3 is an electron microscope photograph showing the cross-section of the alloy coating obtained by slowly cooling the steel sheet hot-dipped with a zinc-aluminum-magnesium-calcium alloy coating in Example 4.

Figure 4:
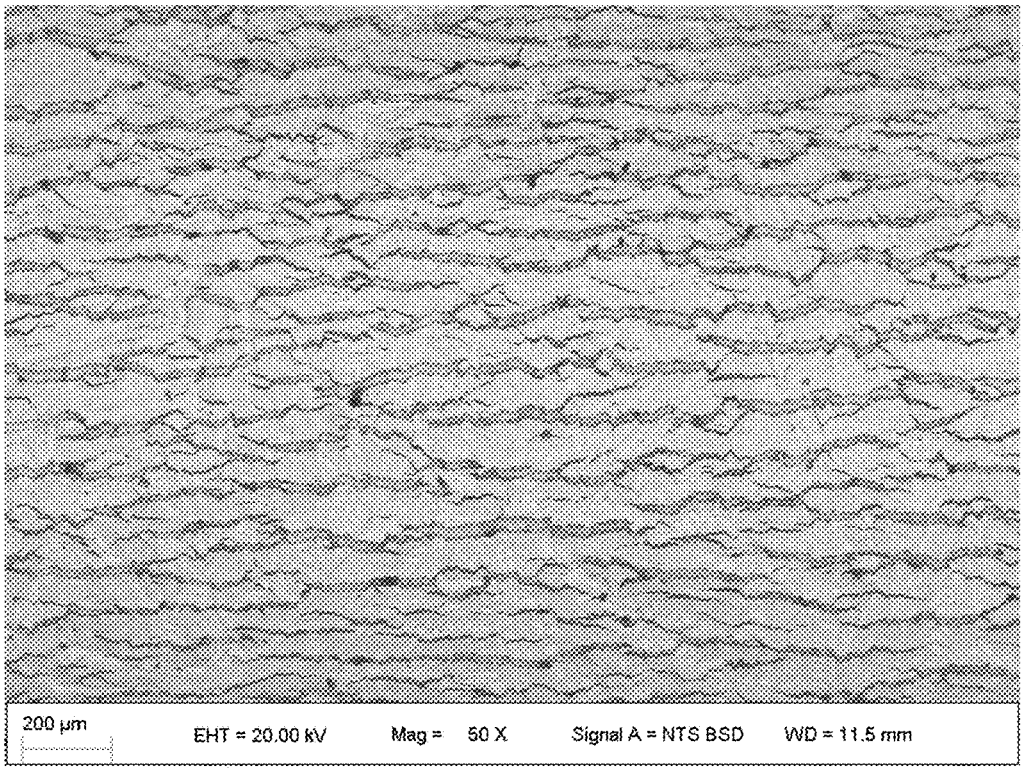
FIG. 4 is a photograph schematically showing the cracks at the 0T bend in Example 3.

FIG. 4 is a photograph schematically showing the cracks at the 0T bend in Example 3.

Figure 5:
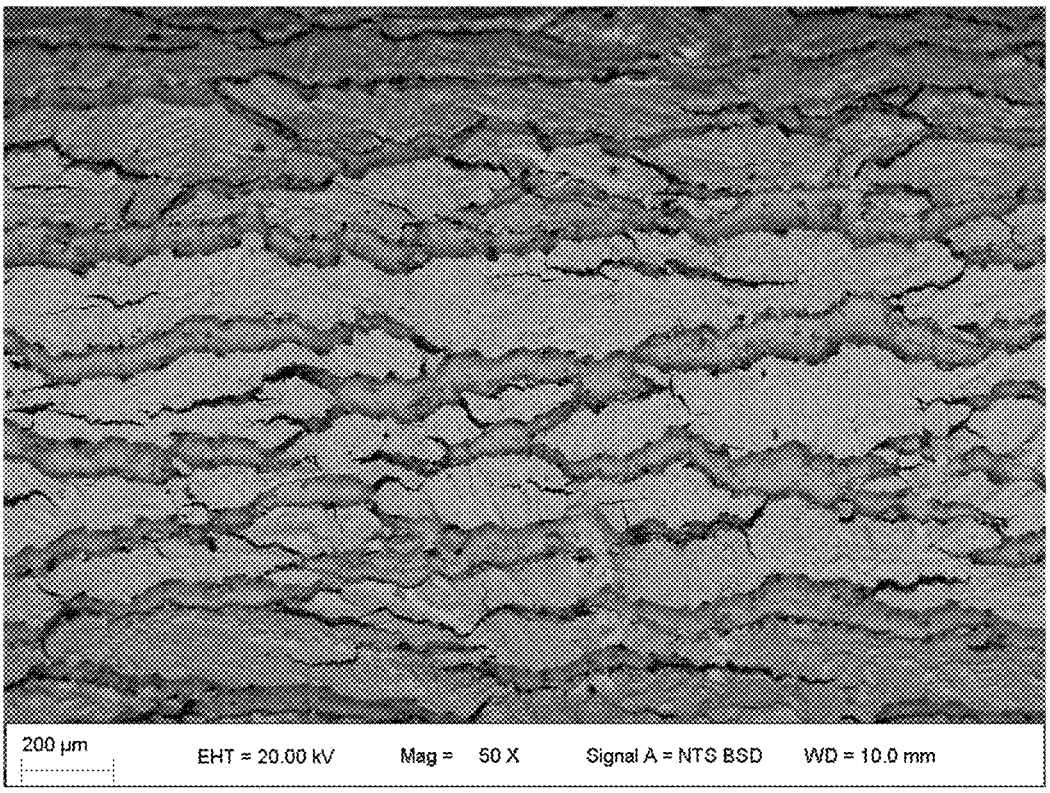
FIG. 5 is a photograph schematically showing the cracks at the 0T bend in Example 4.

FIG. 5 is a photograph schematically showing the cracks at the 0T bend in Example 4.

Comparing FIG. 2 and FIG. 3, it can be seen from the difference in the cross-sectional morphologies of the coatings of Example 3 and Example 4 (FIG. 2 and FIG. 3) that after the coated strip steel was removed from the plating bath, the cooling rate of the rapid cooling had a more significant influence on the structure morphology than the addition of the structure refining elements. The difference in microstructure morphology had no obvious influence on the corrosion resistance, but the cracks on the coating surface at the T-bend were relatively fine when the cooling rate was fast (as shown in FIGS. 4 and 5).

However, regardless of whether the slow cooling shown in Example 4 (at a cooling rate of 10° C./s) or the rapid cooling shown in Example 3 (at a cooling rate of 30° C./s) was used, the interior of the alloy coating obtained finally was composed of an Al-rich phase, a $MgZn_2$ phase, a Zn-rich phase and a $Mg_2Si$ phase, with no obvious intermetallic compound particles other than $Mg_2Si$ observed on its cross section, and the Ca-containing granular intermetallic compound tended to be enriched in the surface layer of the coating.

It should be noted that the prior art in the protection scope of the present disclosure is not limited to the Examples set forth in the present application file. All prior art that does not contradict the solution of the present disclosure, including but not limited to prior patent documents, prior publications, prior public uses, etc., can be included in the protection scope of the present disclosure.

In addition, it should be noted that combinations of the various technical features in this case are not limited to the combinations described in the claims of this case or the combinations described in the specific Examples. All technical features recorded in this case can be combined freely or associated in any way unless a contradiction occurs.

It should also be noted that the Examples listed above are only specific embodiments of the present disclosure. Obviously, the present disclosure is not limited to the above Examples, and changes or modifications made thereto can be directly derived from the present disclosure or easily conceived of by those skilled in the art, all of which fall within the protection scope of the present disclosure.

What is claimed is:

1. A steel sheet hot-dipped with a zinc-aluminum-magnesium-calcium alloy coating, comprising a steel substrate and an alloy coating on a surface of the steel substrate, wherein the alloy coating comprises the following chemical elements in mass percentages:

Al: 12-27%, Mg: 2-8%, Ca: 0.02-5%, Si: 0.15-1.0%, optionally one or both of Ti: 0.01-0.1% and B: 0-0.05%, and a balance of Zn and unavoidable impurities;

wherein the mass percentages of Al, Mg and Ca in the alloy coating further satisfy the following relationships: $4\% \leq (Mg+Ca) \leq 10\%$, $Al/(Mg+Ca) \geq 2.5$;

wherein the alloy coating has a microstructure comprising: an Al-rich phase, a $MoZn_2$ phase, a Zn-rich phase and a $Mg_2Si$ phase, and a granular intermetallic compound enriched with elements Mg and Ca;

wherein the granular intermetallic compound includes at least one of the following: $MoZn_2$, $Mg_2Si$, $Al_2Ca$, $Al_4Ca$, $Al_2CaSi_2$, and $Ca_3Zn$;

wherein the alloy coating has a hardness of 140-240 Hv; and wherein there is no obvious defects on the surface of the alloy coating, or the number of defects is ≤4/100 m on the surface of the alloy coating when rated by observing with naked eyes, and there is no peeling from the alloy coating or there are 1-2 peeling points on the tape visible to naked eyes when tested according to a T-bend adhesion evaluation.

2. The steel sheet hot-dipped with a zinc-aluminum-magnesium-calcium alloy coating according to claim 1, wherein the mass percentages of Al, Mg and Ca in the alloy coating further satisfy the following relationships: 5%<(Mg+Ca)≤9.5%, 2.5≤Al/(Mg+Ca)≤4.

3. The steel sheet hot-dipped with a zinc-aluminum-magnesium-calcium alloy coating according to claim 1, wherein a single-sided coating amount of the alloy coating is 120-300 g/$m^2$.

4. A method for manufacturing the steel sheet hot-dipped with a zinc-aluminum-magnesium-calcium alloy coating according to claim 1, comprising steps of:

(1) immersing a steel substrate annealed in a non-oxidizing atmosphere in a plating liquid of a zinc-aluminum-magnesium-calcium alloy, wherein the plating liquid of the zinc-aluminum-magnesium-calcium alloy has temperature of 460-560° C.;

(2) removing a coated strip steel from a plating bath; subjecting the coated strip steel to gas jet cooling using a cooling jet box, with a cooling rate controlled to be ≥10° C./s, until a temperature of the coated strip steel is lower than 100° C.; and then placing the coated strip steel in a water quenching tank for water cooling.

5. The method according to claim 4, wherein in step (1), when the steel substrate is immersed in the plating liquid of the zinc-aluminum-magnesium-calcium alloy, a relationship between a temperature of the steel substrate $T_{Fe}$ and a temperature of the plating liquid of the zinc-aluminum-magnesium-calcium alloy $T_{zn}$ is controlled to satisfy: ($T_{zn}$-5° C.)≤$T_{Fe}$≤($T_{zn}$+20° C.).

6. The method according to claim 4, wherein in step (2), before the coated strip steel is cooled to a temperature of 340° C., a cooling gas jetted from the cooling jet box is $N_2$ with ≤3% by volume of $O_2$ compressed at ambient temperature.

7. The method according to claim 4, wherein in step (2), the temperature of the coated strip steel is controlled to be ≤250° C. when it reaches a top roller.

8. The method according to claim 4, wherein a first-stage cooling jet box is set at a height of 2-4m from a surface of the plating liquid of the zinc-aluminum-magnesium-calcium alloy in the plating bath.

9. The method according to claim 4, wherein a surface of the plating bath is covered with a sealing housing, and an atmosphere inside the sealing housing is: an inert gas with ≤3% by volume of $O_2$.

10. The method according to claim 4, wherein the coated strip steel between the first-stage cooling jet box and the plating bath is protected using a sealing box.

11. The method according to claim 4, wherein before the coated strip steel is cooled to a temperature of 340° C., a sealing box is arranged for the strip steel between the cooling jet box and the plating bath, and inert atmosphere protection is employed.

12. The method according to claim 4, wherein the mass percentages of the chemical elements in the alloy coating are: Al: 12-27%, Mg: 2-8%, Ca: 0.02-5%, Si: 0.15-1.0%, and a balance of Zn and unavoidable impurities; and the mass percentages of Al, Mg and Ca in the alloy coating further satisfy the following relationships: 4% ≤(Mg+Ca) ≤10%, Al/(Mg+Ca)≥2.5.

* * * * *